United States Patent [19]

Bisbing

[11] Patent Number: 4,978,152

[45] Date of Patent: Dec. 18, 1990

[54] SLAM-ACTION LATCH WITH EJECTOR SPRING

[75] Inventor: Robert H. Bisbing, Springfield, Pa.

[73] Assignee: Southco, Inc., Concordville, Pa.

[21] Appl. No.: 395,660

[22] Filed: Aug. 18, 1989

[51] Int. Cl.[5] ..... E05C 1/12

[52] U.S. Cl. ..... 292/169; 292/DIG. 72

[58] Field of Search ..... 292/DIG. 72, DIG. 73, 292/341.12, 334, 169; 70/DIG. 33, DIG. 36, DIG. 52

[56] References Cited

U.S. PATENT DOCUMENTS

| | | | |
|---|---|---|---|
| 1,431,562 | 10/1922 | Bolles | 292/DIG. 72 |
| 1,593,011 | 7/1926 | Bourgon | 292/DIG. 72 |
| 1,808,458 | 6/1931 | Flynn | 292/DIG. 72 |
| 2,233,278 | 2/1941 | Aldeen | 292/DIG. 72 |
| 3,650,554 | 3/1972 | Tharp | 292/DIG. 72 |
| 3,737,184 | 6/1973 | Swartz | 292/DIG. 72 |
| 4,109,950 | 8/1978 | Amdal | 292/DIG. 72 |
| 4,470,624 | 9/1984 | Bisbing | 292/169 |
| 4,525,004 | 6/1985 | Tanaka | 292/DIG. 72 |
| 4,544,191 | 10/1985 | Nakama | 292/DIG. 72 |
| 4,863,208 | 9/1989 | Streett | 292/DIG. 72 |

OTHER PUBLICATIONS

Southco Fasteners Handbook 33, ©1983; Southco, Inc., pp. G-3, G-4, G-5.

*Primary Examiner*—Eric K. Nicholson
*Attorney, Agent, or Firm*—Paul & Paul

[57] ABSTRACT

A positive position indicator that is used on a variety of non-rotatable, cabinet slam-action pawl latches is disclosed. The indicator uses stored spring forces, stored in a thin, twin-leafed flat spring having a plurality of spring bends therein, to react against a latch keeper attached to the cabinet frame. The stored spring forces cause a spring tab to dislodge the latch pawl from an adjacent flat surface and move the latch housing and cabinet door away from the frame.

15 Claims, 2 Drawing Sheets

SLAM-ACTION LATCH WITH EJECTOR SPRING

BACKGROUND OF THE INVENTION

A very useful style of single-hole mount fastener for cabinets or other similar uses has a non-rotatable latch housing, mounted in a swinging door, that carries a reciprocating spring-loaded pawl that fastens against the edge of a metal keeper installed on the inside of the cabinet frame. As the door is closed, the pawl, which slidingly operates against an extension spring in a perpendicular direction to the direction of the mounted housing, presents a cam surface to the keeper. As the door moves closer to its fully closed position, the cam surface of the pawl slides to its outer end, in opposition to the spring, until it clears the keeper and the stored-up spring force then moves it back out to an extended and latched position with the pawl now presenting a non-cam surface to the keeper. Various types of opening actions, such as twisting a knob or a key or pushing a knob or other activation means, provide retraction of the pawl to ensure clearance of the non-cam surface past the keeper, to unfasten the latch and allow the door to be pulled open away from the frame.

A disadvantage of this type of fastener, whether key-operated or knob-operated, is that there is no positive-feel position showing when the latch is fully open, and therefore when the door can be pulled open, and the operator must remember to provide an opening force - thereby pulling the pawl away from the keeper - at the moment the outer end of the upper or non-cam surface clears the edge of the keeper. Otherwise, the possibility exists that an opening force used by the operator will jam the pawl against the keeper, thereby causing damage to either, or both, the keeper or the pawl.

Another disadvantage to the slam-action latch that uses a non-key push-button as the latch actuator is that there is no structure, other than the push-button knob, which can be pulled on to open the door. Once the push-button knob is depressed, the latch becomes flush-mounted, and presents no object for the user to grasp.

SUMMARY OF THE INVENTION

A positive position indicator for a single-hole mount, pawl latch cabinet fastener is disclosed whereby a spring is held at its rear end against the backside of a non-rotating pawl latch and flexibly surrounds, with twin spring leaves, the latch housing to present a spring tab adjacent the frontside thereof, said tab also being adjustably adjacent with a non-cam surface side of the pawl. The latch housing has holding means, in the form of a rear slot or slight protrusion, at its backside to provide a non-slip base for the rear end of the spring, and twin, opposed ledges, on the undersurface of the tubular latch housing, to provide bracing points at desired locations for spring action of the leaves. Each of the twin spring leaves is formed with predetermined major and minor bends therein to give the desired spring-force reaction to the spring tab at the front. Additionally, depending on the variation of knob actuator used, a conveniently sized pull-tab is mounted at the base of the actuating means to provide structure to pull open the cabinet door.

OBJECTS OF THE INVENTION

It is therefore an object of the present invention to provide a positive position indicator for a pawl latch cabinet fastener that uses stored-up spring force to react against a door frame and reveal that the door is no longer latched.

It is a further object of the present invention to provide a positive position indicator that can be attached to cabinet pawl latches using a plurality of opening forces.

It is a still further object of the present invention to provide a door-latch having push button actuation wherein the force springing open the door is of a magnitude greater than the push-button depressing force.

It is a still further object of the present invention to provide a positive position indicator attached to a push-button pawl latch that uses a pull tab mounted at its base.

These and other features, objects and advantages of the invention will, in part, be pointed out with particularity and will, in part, become obvious from the more detailed description of the invention taken in conjunction with the accompanying drawings which form an integral part thereof.

DETAILED DESCRIPTION OF THE PREFERRED EMBODIMENT

Figure 1:
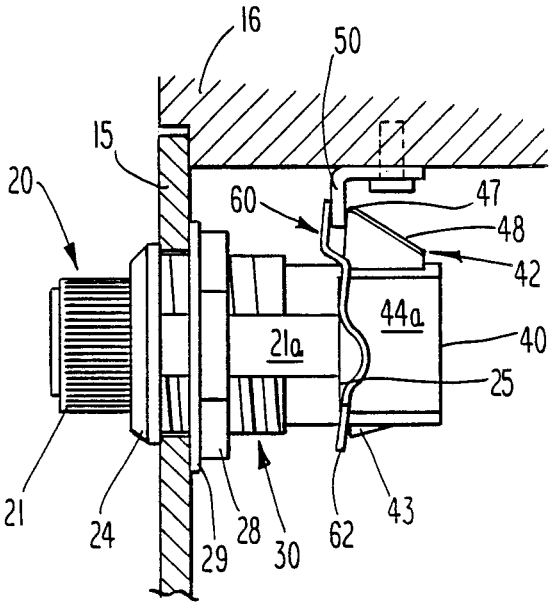
FIG. 1 shows a side elevation view of one embodiment of an improved slam-action latch, installed on a closed cabinet door (only partially shown)

The improved slam-action latch, as shown in one embodiment by a side elevation view in FIG. 1, generally has the shape of an "L" with the actuator 20 (at the front end) and latch housing 30 forming the longer leg and the pawl housing 40 (at the rear end) and pawl 42 forming, at a right angle thereto, the shorter leg. Actuator 20, which can be one of several different forms, such as a key-operated tumbler, or a push-button operated cam, or a twist-style camming knob, as will be described, and latch housing 30 are aligned along an imaginary axis extending longitudinally through the both of them.

The latch housing 30, which can be made from die cast zinc, has a generally tubular and threaded exterior shape with a pair of oppositely-disposed, flattened areas 21*a*, 21*b* on the sides, to present an end profile similar to the "double D" (as is known in the industry), and extends for a pre-selected length from the exterior mounting flange 24 to an overhang 25 which is formed on the underside of the latch housing at the intersection of latch housing 30, and the generally box-shaped pawl housing 40. Installation of the latch, in a cabinet door 15, for instance, is accomplished by inserting latch housing 30 through a hole of similar shape in door 15 and tightening nut 28 tightly against a washer 29 to position, in a rigid and non-rotating manner, pawl housing 40 adjacent a flat surface, such as a keeper 50.

Pawl housing 40 has preferred exterior dimensions of length substantially equal to the diameter of latch housing 30 and width slightly less than the diameter of the latch housing and fits against the overhang 25 of latch housing 30. The pawl housing 40 has flat, oppositely-disposed parallel sides 44*a,b* and an orthogonally-situated bottom surface 46 attached thereto. The contour of the rear and front of the pawl housing generally conform, in radial curvature, to the circumference of the latch housing, with the front having an opening therein for reciprocating movement of the pawl.

Pawl 42 reciprocates, in a direction perpendicular to the imaginary longitudinal axis, in and out of pawl housing 40 according to either force by keeper 50, against its cam surface or the spring force, as seen by the phantom line 42*a* and the arrows adjacent thereto. The pawl, which is made of a predetermined thickness to slide against the inside surfaces of the side walls, has an outward extending part 47 that has a bottom, camming or sloping, surface 48 which joins a generally flat and non-camming, upper surface 49. Pawl 42 is spring-biased, as is known, to have its outward extending part 47 protrude a specified amount out of pawl housing 40. This offers a preselected amount of the non-camming surface 49 to catch against a flat surface, such as a projection of keeper 50, or other edge, as will be explained, to provide fastening of cabinet door 15 to framework 16.

Figure 4:
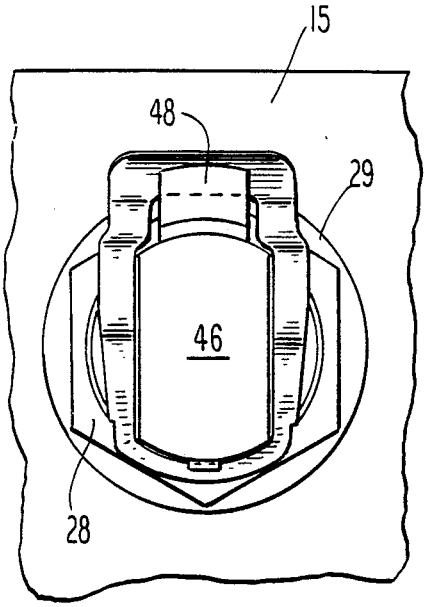
FIG. 4 shows a rear elevational view of a latch with the present invention thereon taken along lines IV—IV of FIG. 3.
Figure 3:
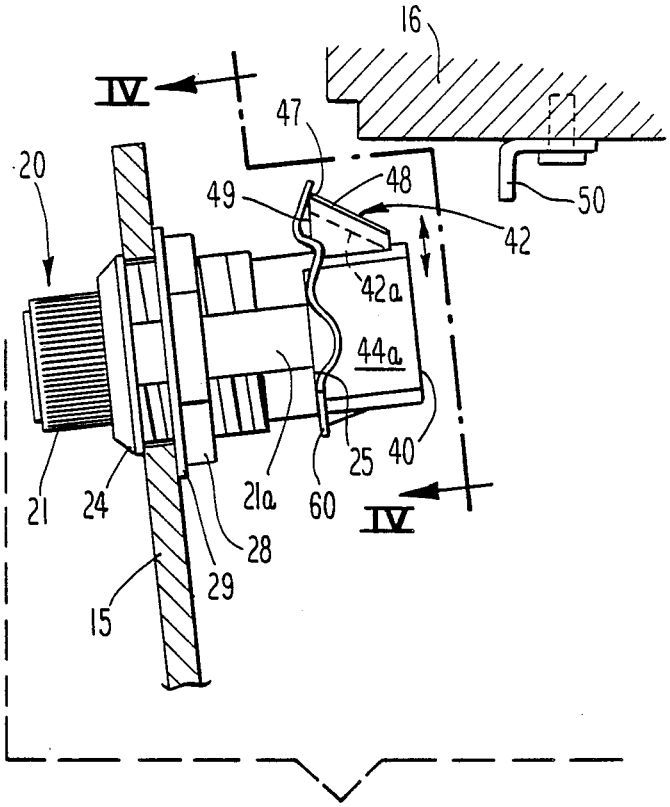
FIG. 3 shows a side elevation view, similar to FIG. 1, of the slam-action latch, with the present invention thereon, mounted on a slightly opened cabinet door (only partially shown)
Figure 2:
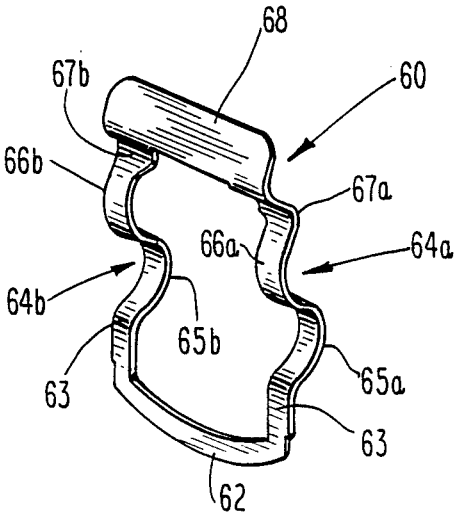
FIG. 2 shows an isolated perspective view of an embodiment of the positive position indicator.
Figure 5:
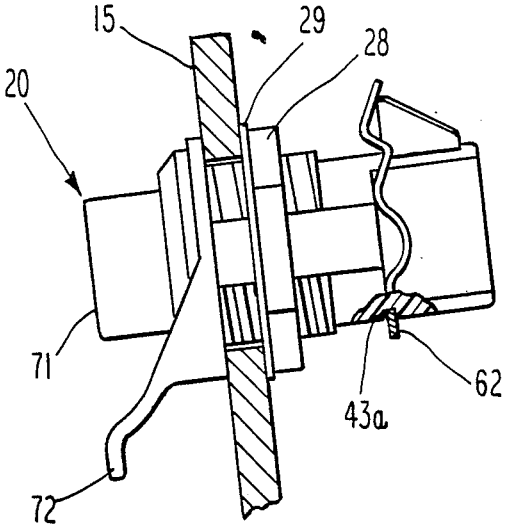
FIG. 5 shows a fragmentary side elevation view of an alternate embodiment of an improved slam-action latch with the present invention thereon as installed on a cabinet door (only partially shown)

The addition of a biasing means, such as spring 60, to the slam action latch gives the latch a positive position indicator. Spring 60, as seen in an isolated perspective view in FIG. 2, is a generally thin, rectangular-shaped piece of spring steel that has an aperture of predetermined dimensions stamped out of it to form a rear section 62, twin, parallel leaf sections 64*a,b*, with a plurality of predetermined deformities therein, and a front tab section 68. Spring 60 slidingly fits adjacent overhang 25 of latch housing 30 with rear section 62 fitting against a projection 43 from the rear side of pawl housing 40, or, as shown in an alternate embodiment of FIG. 5, in a slot 43*a* in the rear side of pawl housing 40, and with flat sections 63 set against adjacent surfaces of overhang 25. This construction causes the rear end of the spring to be anchored at the rear end of pawl housing 40 to provide a constraint on spring forces stored in spring 60, as will be explained.

Spring 60, as clearly shown in FIG. 2, has, in each of its twin leaf sections 64*a,b*, a plurality of alternating, orthogonally projecting, spring bends 65*a,b*, 66*a,b* and 67*a,b* at preselected locations. The pattern of these spring bends, coupled with the anchored rear section and the projection of tab 68, provides the resiliency of spring 60 that allows it to deform when tab 68 contacts keeper 50 upon latch closing (as shown in FIG. 1). Bends 66*a,b* are forced against corresponding sections of overhang 25 as pawl 42 is forced out to its extended position and tab section 68 transfers the stored spring force to bear against keeper 50. When actuating means 20 is utilized, and a corresponding withdrawing force acts on pawl 42, the stored spring force will, once non-cam surface 49 clears keeper 50, return tab section 68 to its original shape, thereby moving latch housing 30 and cabinet door 15 away from frame 16. The improved slam action latch can therefore provide, when used with a push-button actuator 20, an opening force of the door 15 of a magnitude greater than the force required to depress actuator 20, by forming spring 60 with a spring constant larger than that of the push-button spring (not shown), so that when the push-button actuator 20 is depressed, to free surface 48 from keeper 50, and subsequently released, the door and latch are forced to move outwardly out of position to bring surface 48 far enough away from keeper to have the door stay ajar.

Figure 6:
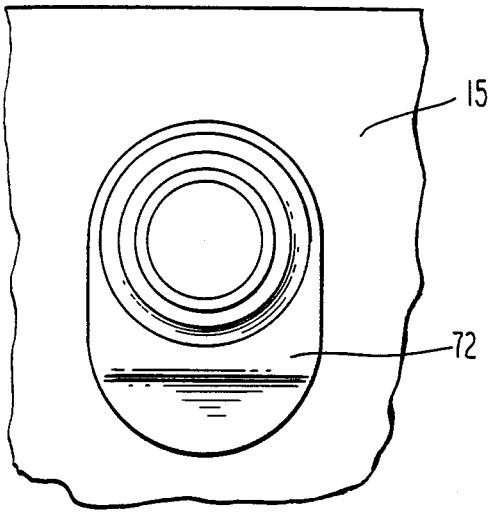
FIG. 6 shows a fragmentary front end elevation of the latch shown in FIG. 5.
Figure 8:
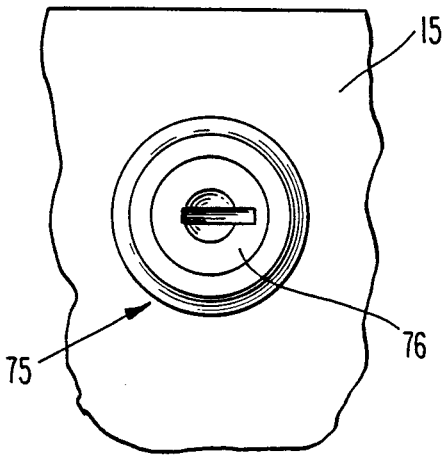
FIG. 8 shows a fragmentary front end elevational view of the latch shown in FIG. 7.
Figure 7:
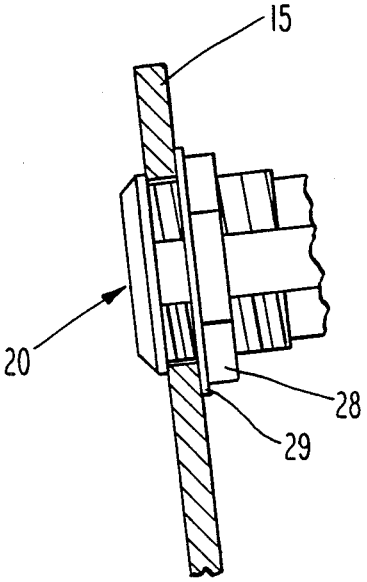
FIG. 7 shows a fragmentary side elevation view of an alternate embodiment of the actuating means of the slam-action latch.

The latch actuating means can conveniently provide alternate devices to open the slam action latch, such as either a projecting, grooved knob 21 that is reciprocatingly rotated to retract pawl 42, or a push-button knob 71 with or without a hand-hold tab 72 fittingly held by external flange 24 and projecting orthogonally therefrom (latch and hand-hold tab seen in FIGS. 5 and 6) or in a flushmounted, key-operated version 75 (key not shown) having a lock plug 76 therein seen in FIGS. 7 and 8. These knobs can be made of mineral filled nylon and the flushmounted lock-plug can be made from die cast zinc. All versions depend upon the reaction forces developed by spring 60 to indicate an open position.

These and other variations in the details of the improved slam-action latch may be made in accordance with the invention, which is to be broadly construed and is to be defined by the scope of the claims appended hereto.

What is claim is:

1. An improved slam-action latch that is mounted for non-rotational latching through one member of a two member closure and contains a latch housing with activating means a front end thereof and having at a rear end a pawl, with at least one non-camming surface perpendicular to said rear end, said housing affixed to said one member and a flat surface of predetermined dimensions affixed to said other member, whereupon closing said one member, said non-camming surface contacts said flat surface, fastens the closure, and sets said activating means for opening the latch, the improvement comprising:

retaining means on the outer surface of the rear end of the housing opposite from said pawl for retaining a biasing means against said housing; and biasing means disposed around said latch housing and adjacent said pawl and said retaining means to releasingly engage a portion of said flat surface and provide a stored energy to react against said flat surface; wherein said biasing means is a thin spring having an aperture therethrough to form a front tab section, two substantially parallel leaf sections extending from said front tab section with each having at least one orthogonally-extending bend therein, and a rear connecting section joining said leaf sections.

2. A slam-action latch, as described in claim 1, wherein said front tab section is of substantially equal width as the width of the pawl.

3. A slam-action latch, as described in claim 1, wherein said activating means comprises a push-button slidingly and reciprocatingly held by the front end of the housing and a tab projecting from the front end.

4. A slam-action latch, as described in claim 1, wherein said activating means comprises a projection rotatingly and reciprocatingly held by the front end of the housing.

5. A slam-action latch, as described in claim 1, wherein said activating means comprises a circular surface, flush with the front end of the housing, and having an aperture therein, and a key for insertion in the aperture to provide sliding and reciprocating movement thereto.

6. A latch for use in securing two closure members together, comprising:

(a) a latch housing adapted for being affixed to a closure member for non-rotational movement relative thereto;

(b) a keeper adapted for being fixedly secured to another closure member;

(c) a pawl housing fixedly connected with said latch housing and forming a longitudinal extension thereof;

(d) a pawl having at least one non-camming surface mounted within said pawl housing for reciprocal movement between extended and retracted positions relative thereto;

(e) latch actuating means connected to said latch housing at a location thereon opposite the connection between said latch housing and said pawl housing, said latch actuating means comprising means for selectively moving said pawl into said retracted position;

(f) biasing means disposed around said pawl housing and adjacent said latch housing and positioned to contact said at least one non-camming surface of said pawl, wherein when said at least one non-camming surface of said pawl is engaged with said keeper, said keeper is disposed between said at least one non-camming surface and said biasing means; and (g) wherein said biasing means comprises means for (1) biasing said latch housing away from said keeper; and (2) biasing said pawl toward said retracted position to facilitate the engagement of said pawl with said keeper.

7. The latch of claim 6, wherein said latch housing is of substantially cylindrical shape with longitudinal flattened sections disposed on opposite sides thereof.

8. The latch of claim 6, wherein the width of said pawl housing is less than the diameter of said latch housing, whereby a shoulder is formed at the connection between said pawl housing and said latch housing, and wherein said biasing means is disposed against said shoulder of said latch housing.

9. The latch of claim 6, wherein said pawl housing further comprises retainer means for retaining said biasing means against said latch housing.

10. The latch of claim 6, wherein said biasing means comprises a thin spring having an aperture therein and includes a front tab section, two substantially parallel leaf sections extending from said tab section, section of said leaf sections having at least one orthogonally-extending bend therein, and a rear connecting section joining said leaf sections.

11. The latch of claim 6, wherein said actuating means comprises a rotatable knob longitudinally extending from said latch housing.

12. The latch of claim 6, wherein said actuating means comprises a cylindrical push-button slidingly mounted within said latch housing for reciprocal movement between extended and retracted positions relative to said latch housing.

13. The latch of claim 6, wherein said actuating means comprises locking cylinder means flush mounted with an end of said latch housing.

14. The latching of claim 6, wherein said reciprocal movement of said pawl occurs along an axis perpendicular to a longitudinal axis of said latch housing.

15. The latch of claim 6, wherein said latch housing further comprises a flange disposed adjacent to said actuating means and positioned to engage a closure member when said latch housing is affixed to a closure member, and means for affixing said flange in clamped-engagement with a closure member.

* * * * *